US010576495B2

(12) United States Patent
Roe

(10) Patent No.: US 10,576,495 B2
(45) Date of Patent: Mar. 3, 2020

(54) ROLLER COVER ADAPTER

(71) Applicant: Australian Brushware Corporation PTY LTD, Campbellfield (AU)

(72) Inventor: Matthew Lee Roe, Campbellfield (AU)

(73) Assignee: Australian Brushware Corporation PTY LTD, Hawthorn East (AU)

( * ) Notice: Subject to any disclaimer, the term of this patent is extended or adjusted under 35 U.S.C. 154(b) by 247 days.

(21) Appl. No.: 15/886,272

(22) Filed: Feb. 1, 2018

(65) Prior Publication Data

US 2018/0214907 A1 Aug. 2, 2018

(30) Foreign Application Priority Data

Feb. 2, 2017 (AU) ..... 2017900312

(51) Int. Cl.
*B05C 17/02* (2006.01)

(52) U.S. Cl.
CPC ..... *B05C 17/023* (2013.01); *B05C 17/0205* (2013.01); *B05C 17/0217* (2013.01); *B05C 17/0222* (2013.01)

(58) Field of Classification Search
CPC ..... B05B 17/023; B05B 17/0205; B05B 17/0217; B05B 17/0222
See application file for complete search history.

(56) References Cited

U.S. PATENT DOCUMENTS 5,784,798 A 7/1998 Taylor

*Primary Examiner* — Shay Karls
(74) *Attorney, Agent, or Firm* — Buchanan Ingersoll & Rooney PC

(57) ABSTRACT

A paint roller adapter enabling a large diameter paint roller cover to be used on a paint roller frame having a cage configured to receive smaller paint roller covers. The adapter is generally cylindrical in shape and comprises a cylindrical internal surface having a diameter sized to fit onto the cage of the roller frame and a substantially cylindrical external surface having a diameter sized to fit within the large paint roller cover. At least one gripping member projects outward, beyond the external surface of the adapter such that, in use, the gripping member(s) press against an internal surface of the large paint roller cover. The gripping members of the adapter serve to prevent the roller cover slipping about the external surface of the adapter. A pair of such adapters thereby enables a conventional paint roller frame to be used with large diameter roller covers.

13 Claims, 6 Drawing Sheets

ROLLER COVER ADAPTER

FIELD OF THE INVENTION

The present invention relates generally to paint rollers. In particular, the invention concerns an adapter to enable a large diameter paint roller cover to be used on a paint roller frame having a cage size intended for smaller paint roller covers.

CROSS REFERENCE TO RELATED APPLICATION

This application claims priority from Australian provisional patent application number 2017900312 filed on 2 Feb. 2017, the entire content of which is incorporated herein by cross-reference.

BACKGROUND TO THE INVENTION

An example of a conventional paint roller frame is shown in FIG. 1 of the accompanying drawings. The roller frame 1 includes a cage 2 having a plurality of resiliently deformable metal bars 3 spaced about an axis of rotation corresponding to a central shaft 4. The ends of the bars 3 are secured to a pair of end supports 5, 6 which serve to hold the bars in fixed circumferential positions and allow the bars to flex inwardly towards the shaft 4. The end support 5 at the free end of the cage 2 is cylindrical in shape to enable a roller cover (not shown) to slide over this end support and then be pushed onto, and subsequently gripped by, the bars 3. The other end support 6 is also cylindrical in shape but includes an end stop 7 to limit axial movement of the roller cover on the cage 2. The end supports 5 and 6 freely rotate about the central shaft 4 to allow free rotation of the cage 2 and the roller cover relative to the roller frame 1. An arm 8 connects the shaft 4 to a handle 9.

A conventional roller cover, also referred to as a roller sleeve, includes a cylindrical core which is covered with an absorbent material such as a napped fibre. In the context of paint roller covers, the size of a roller cover ("large", "small", etc.) refers to the diameter of its core rather than to its length. In Australia, for example, conventional paint roller covers have a cylindrical core with a nominal internal diameter of 38 mm. But typical samples may range in size between 37 mm and 39 mm depending on the manufacturer. It is for this reason that paint roller frames are generally provided with a resilient cage structure of the type described above.

Paint roller covers also come in varying lengths, and frames with cages of corresponding lengths are provided for each roller cover length.

While 38 mm (1½ inch) is the nominal diameter of conventional paint roller covers in Australia, larger diameter covers are available in some countries. For example, covers of 45 mm (1¾ inch), 51 mm (2 inch), 57 mm (2¼ inch) and 64+mm (2½+ inch) have been found to be commercially available. Larger diameter covers have a number of benefits including:

a) a larger rolling diameter, resulting in smoother operation for the user when applying paint and making it easier to push the roller along a surface;

b) smoother paint finish;

c) greater area of absorbent material around the circumference of the roller cover, whereby the larger cover area holds more paint;

d) with a thicker nap, or pile, of absorbent material there is an increase in the amount of paint which can be picked up and held by the cover, again resulting in more paint on the roller; and e) during painting, there is less requirement to "load" the roller, for example when painting a room, thereby minimising the need for the user to bend over to load paint from a tray.

With these benefits in mind, it would be desirable to provide some way to install a large diameter cover on a conventional frame intended for smaller diameter covers. The present invention is accordingly directed to meeting this need.

SUMMARY OF THE INVENTION

The present invention accordingly provides a paint roller adapter for enabling a relatively large paint roller cover to be used on a paint roller frame which has a cage configured to receive smaller paint roller covers. The adapter is generally cylindrical in shape, as herein defined, and comprises a cylindrical internal surface having a diameter sized to fit onto the cage of the roller frame and a substantially cylindrical external surface having a diameter sized to fit within the large paint roller cover. At least one gripping member projects outward, beyond the external surface of the adapter such that, in use, the gripping member(s) press against an internal surface of the large paint roller cover.

Throughout this specification the term "cylindrical" is to be interpreted broadly and is not restricted to an ideal cylinder having a purely circular cross-section. Instead, the term is intended to include all three dimensional shapes having a continuous surface surrounding a volume of space about a central axis. As such, the cross-section may form a polygon having multiple straight sides joined together to enclose the space. For example, a decagon, an octagon, a hexagon, and even a square or triangle, would be considered "cylindrical" within the context of the present specification.

Given the above broad definition for the term "cylindrical", the corresponding term "diameter" is also to be interpreted broadly. The notional diameter of a polygon may be defined as twice the distance between the central axis and a midpoint on each side of the polygon. Alternatively, the diameter could be defined by an alternative point on each side of the polygon, such as the corners of the polygon which are at the greatest distance from the central axis.

Similarly, the terms "comprises", "comprising" and grammatical variations thereof, when used in this specification are to be taken to specify the presence of stated features, integers, steps or components or groups thereof, but do not preclude the presence or addition of one or more other features, integers, steps, components or groups thereof.

In one embodiment a plurality of gripping members are provided. Preferably, three gripping members are provided but any alternative number could instead be provided.

The gripping members of the adapter serve to prevent the roller cover slipping about the external surface of the adapter, while the internal surface of the adapter can be gripped by the cage arrangement of a conventional paint roller frame. A pair of such adapters thereby enables a conventional paint roller frame, which many DIY users and professional painters already own, to be used with newly available large diameter roller covers. This provides all the benefits of large roller covers without significant additional outlay for the purchase of larger paint roller frames.

In one embodiment of the invention, the paint roller adapter comprises a pair of coaxial cylindrical walls, one at least partially within the other, such that they are spaced about an axis of rotation of the cage. An inner wall has radially inner and outer surfaces such that the inner surface of the inner wall defines the cylindrical internal surface of the adapter. An outer wall has radially inner and outer surfaces such that the outer surface of the outer wall defines the substantially cylindrical external surface of the adapter. The outer wall preferably includes a plurality of apertures spaced around its circumference, and each gripping member comprises a substantially radially extending finger which projects from the outer surface of the inner wall through one of the apertures in the outer wall.

Preferably, each aperture in the outer wall comprises an elongated slot which extends axially along the outer wall, and each radially extending finger has a wide tab-shape with: its width extending axially along the corresponding slot; its thickness extending across the slot; and its length extending substantially radially from the outer surface of the inner wall towards and through the slot in the outer wall.

In one embodiment, each radially extending finger is resiliently deformable by compression towards the axis. Preferably, each radially extending finger comprises a shallow S-shape when viewed in cross section in a plane perpendicular to the axis. Such an S-shape is advantageous in that it may act as a form of spring.

In a further embodiment the adapter further comprises an end wall having an outer surface extending radially between the cylindrical internal surface and the substantially cylindrical external surface. This radially extending outer surface provides a barrier to prevent paint entering the adapter and into the roller cage. It also prevents paint build up at the end of the roller cover during use.

The inner wall preferably has a length of about 50 to 70 mm, and more preferably about 60 mm. The outer wall preferably has a length of about 20 to 40 mm, and more preferably about 30 mm.

In some embodiments of the adapter the cylindrical internal surface has a diameter of about 38 mm. In the same or other embodiments the substantially cylindrical external surface has a diameter of about 57 mm.

Preferred embodiments of the invention will now be described with reference to the accompanying drawings. These embodiments are given by way of illustration only and are not intended to limit the generality of the preceding description of the invention.

DESCRIPTION OF PREFERRED EMBODIMENTS

Figure 1:
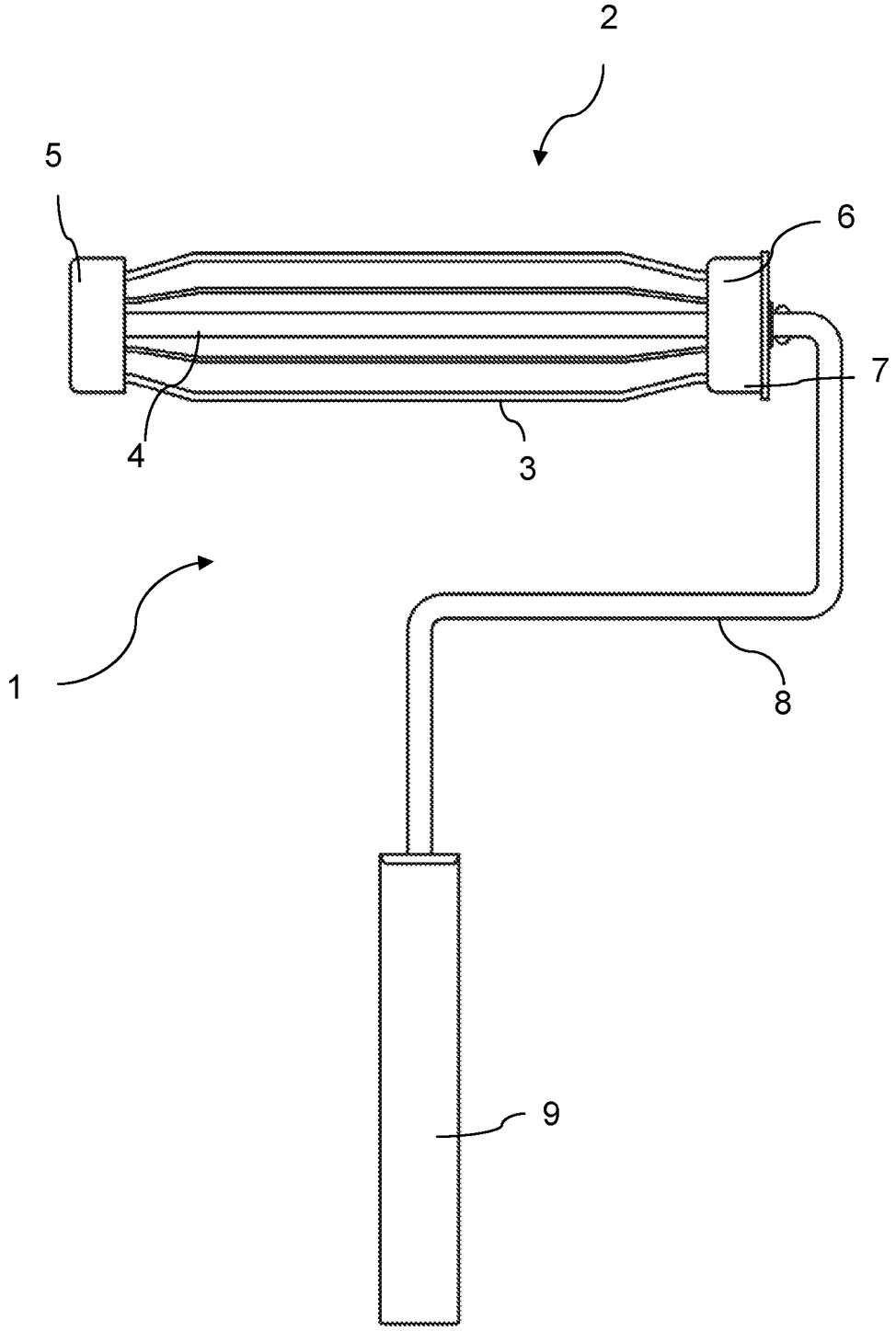
FIG. 1 shows a conventional paint roller frame of a type suitable for use with the present invention.
Figure 2:
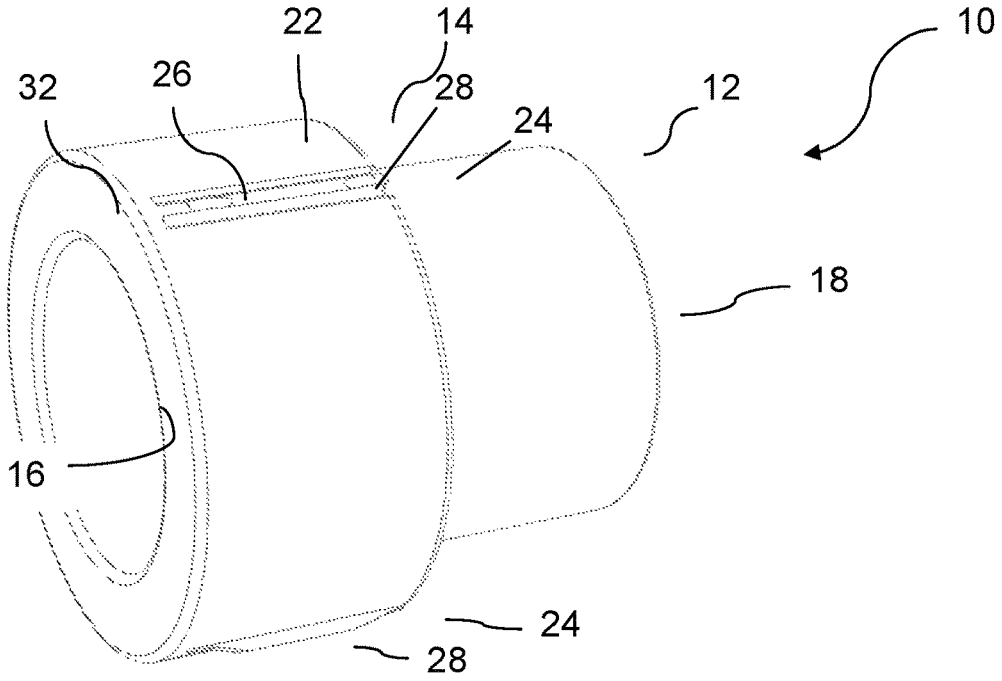
FIG. 2 is an end perspective view of a paint roller adapter in accordance with an embodiment of the invention.

Referring now to FIGS. 2-7 of the accompanying drawings there is shown a paint roller adapter 10 in accordance with an embodiment of the invention. This adapter enables a large diameter paint roller cover (not shown in these figures, but partially shown in FIG. 8) to be used on a conventional paint roller frame 1, of the type shown in FIG. 1, having a cage 2 configured to receive a smaller paint roller cover.

The adapter is generally cylindrical in shape and comprises a pair of coaxial cylindrical walls 12, 14, one partially within the other, such that in use of the paint roller the walls are spaced about an axis of rotation of the roller cage. As can be best seen in FIG. 3, the inner wall 12 has a radially inner surface 16 and a radially outer surface 18, and the inner surface 16 of the inner wall 12 defines a cylindrical internal surface of the overall adapter 10. Similarly, the outer wall 14 has a radially inner surface 20 and radially outer surface 22, and the outer surface 22 of the outer wall 14 defines a substantially cylindrical external surface of the overall adapter 10.

The cylindrical internal surface has an internal diameter which is sized to fit the cage 2 of a conventional frame. Typically, this would be a diameter of 38 mm but could be of a different size depending on the design of the cage or other arrangement employed to grip a conventional roller cover. The cylindrical outer surface 22 has an external diameter which is sized to fit within the central core of a large paint roller cover.

The adapter 10 also includes gripping members 24 which extend radially outward beyond the cylindrical outer surface 22 such that, in use, they press against an internal surface of the paint roller core. These gripping members serve to prevent the large roller cover slipping on the external surface of the adapter.

In the embodiment shown in the drawings, the outer wall 14 includes a plurality of apertures in the form of elongated slots 26 which extend axially along the length of the outer wall 14. In this embodiment, three slots 26 are spaced around the circumference of the outer wall 14, however four or five slots, or any other number of slots, could instead be provided.

Also in the embodiment shown, each gripping member 24 comprises a substantially radially-extending finger-like member 28 which has a wide tab-shape. Each tab-shaped finger 28 has a width which extends axially along the length of the corresponding slot 26 and a thickness which is less than the width of the slot 26. A small gap exists between the sides of the tab-like finger 28 and the walls of the corresponding slot 26 so as to enable some flexing of the tab-like fingers 28 within the slots 26.

Figure 3:
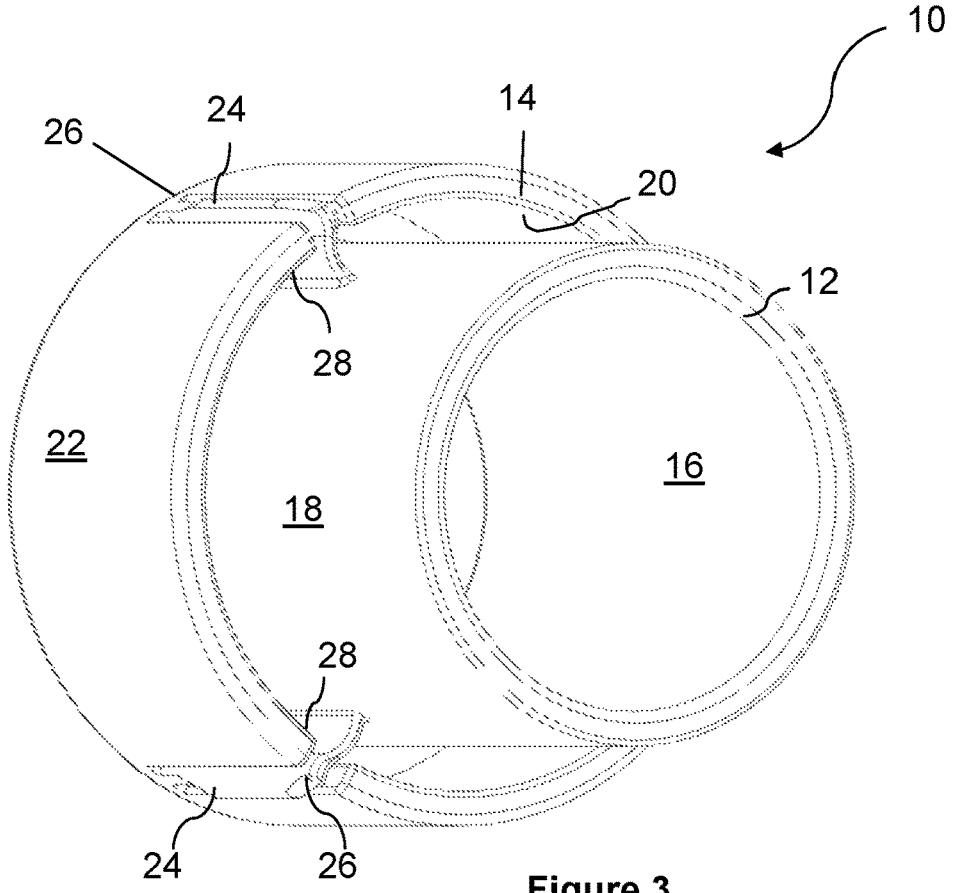
FIG. 3 is another perspective view of the adapter shown in FIG. 2, viewed from the end opposite to that shown in FIG. 2.
Figure 4:
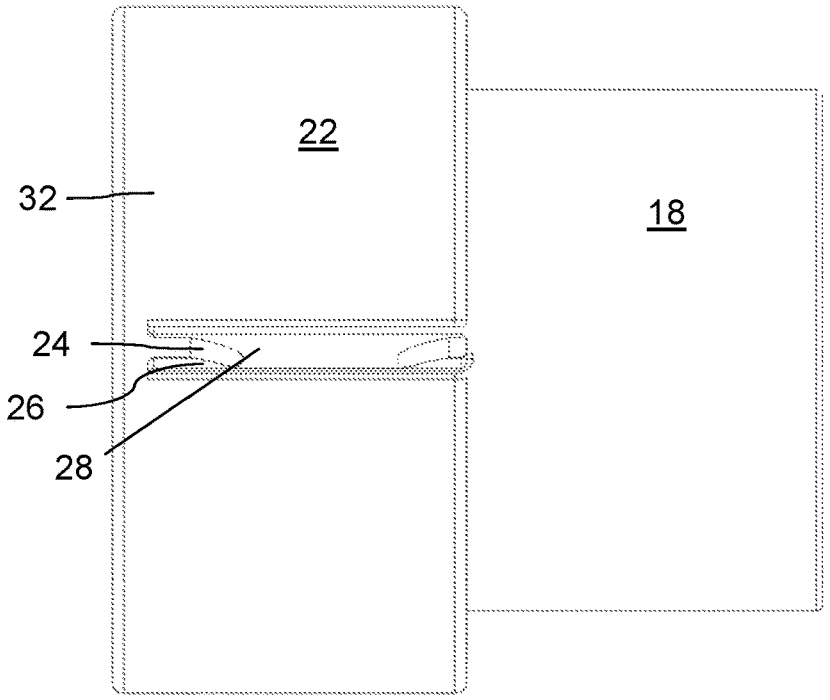
FIG. 4 is a side view of the adapter shown in FIG. 2.
Figure 7:
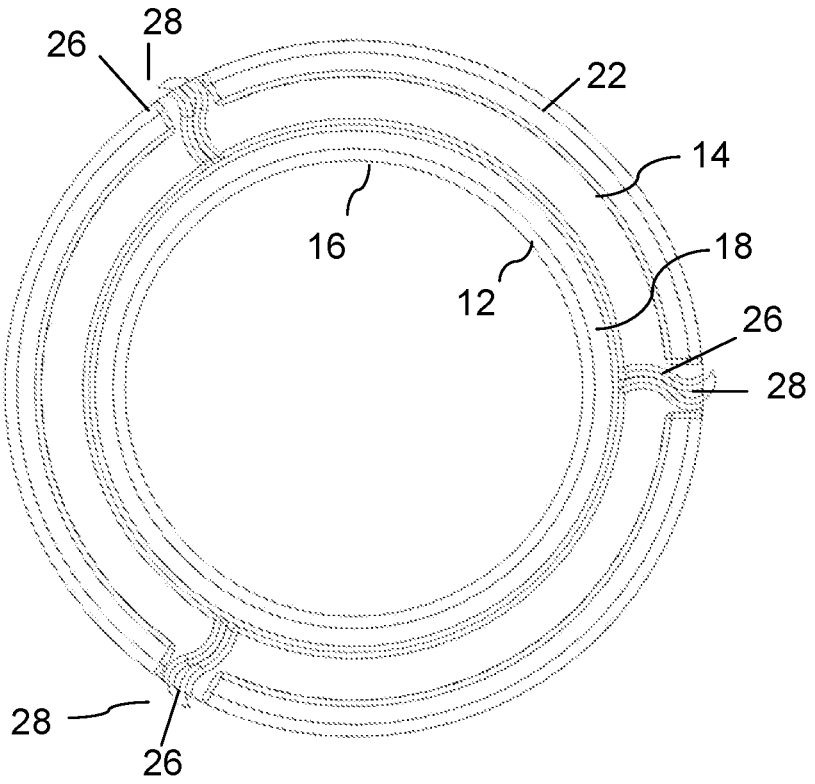
FIG. 7 is another end view of the adapter shown in FIG. 2, taken from the end opposite to that shown in FIG. 6.

As can be best seen in FIGS. 3 and 7, each tab-shaped finger 28 extends radially from the outer surface 18 of the inner wall 12 through a corresponding slot 26 in the outer wall 14. The length of each finger 28 is made sufficient for a free end of the finger to extend beyond the outer surface 22 of the outer wall 14.

Referring again to FIG. 7, it can be seen that each tab-shaped finger 28 also has a shallow S-shape when viewed in cross-section along a plane perpendicular to the axis of rotation. This S-shape, together with some flexibility of the material used to manufacture the adapter 10, enables the S-shaped fingers to resiliently deform like a spring by compression towards the axis. This resilience enables the adapter 10 to be used with a range of roller covers having slight variations in internal core diameter. In the example shown, the nominal internal dimension of the cover is 57 mm but the resilience of the tab-like S-shaped fingers 28 enables the adapter 10 to accommodate variations in diameter of plus or minus 0.5 mm.

In alternative embodiments, not shown, the length of the tab-shaped fingers and/or the exact form of the S-shaped cross-section, could be varied to enable a wider range of variation in cover sizes to be accommodated. For example, the fingers could instead have a cylindrical or square cross section which projects straight out, away from the axis of rotation. Alternatively, or in addition, the fingers could be made of a compressible material such as rubber or flexible polymer.

Figure 5:
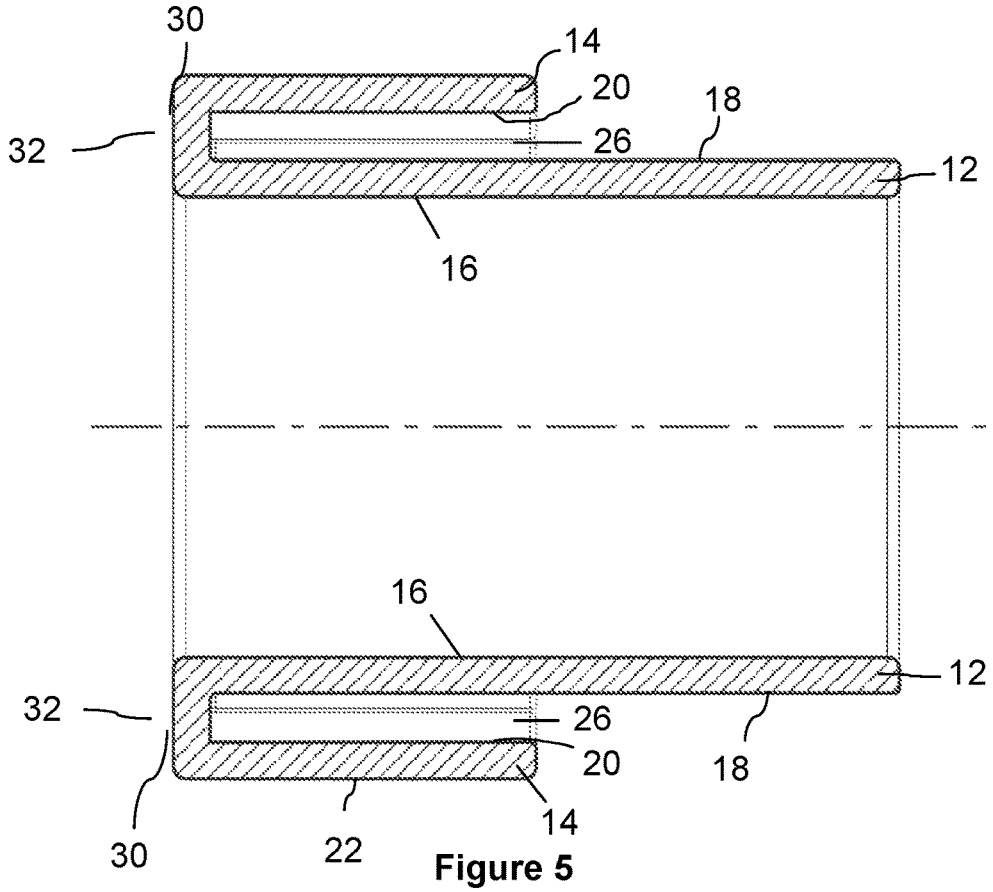
FIG. 5 is a cross-sectional side view of the adapter shown in FIG. 2, taken along an axis of rotation.
Figure 6:
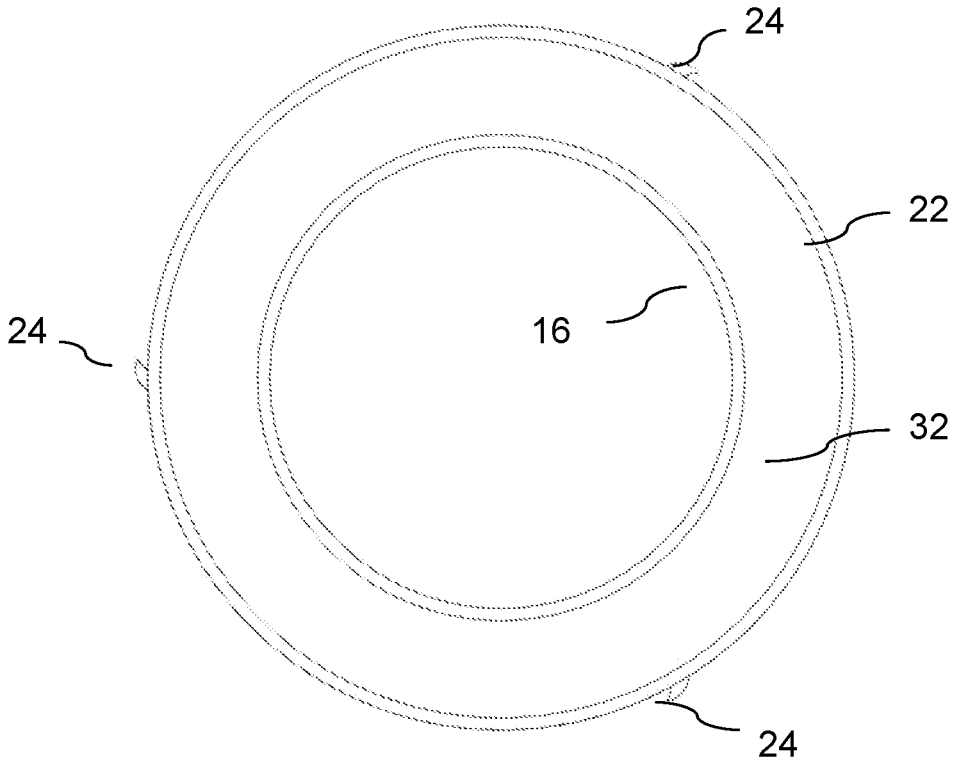
FIG. 6 is an end view of the adapter shown in FIG. 2.

As can be best seen in the cross-section of FIG. 5, the adapter 10 also includes an end wall 30 joining the inner wall 12 to the outer wall 14. In this embodiment, it is the end wall 30 which keeps the inner wall 12 and outer wall 14 in a spaced coaxial relationship. The end wall 30 has an outer surface 32 which extends radially between the cylindrical inner surface 16 of the inner wall 12 and the substantially cylindrical outer surface 22 of the outer wall 14. The outer surface 22 is referred to as "substantially cylindrical" primarily because the surface is broken by the slots 26 which serve to segment the outer wall 14 into three sections, in this embodiment. It will be appreciated that the outer "wall" could instead be formed by any number of sections which together form an effective surface to support an internal surface of a paint roller cover.

Figure 8:
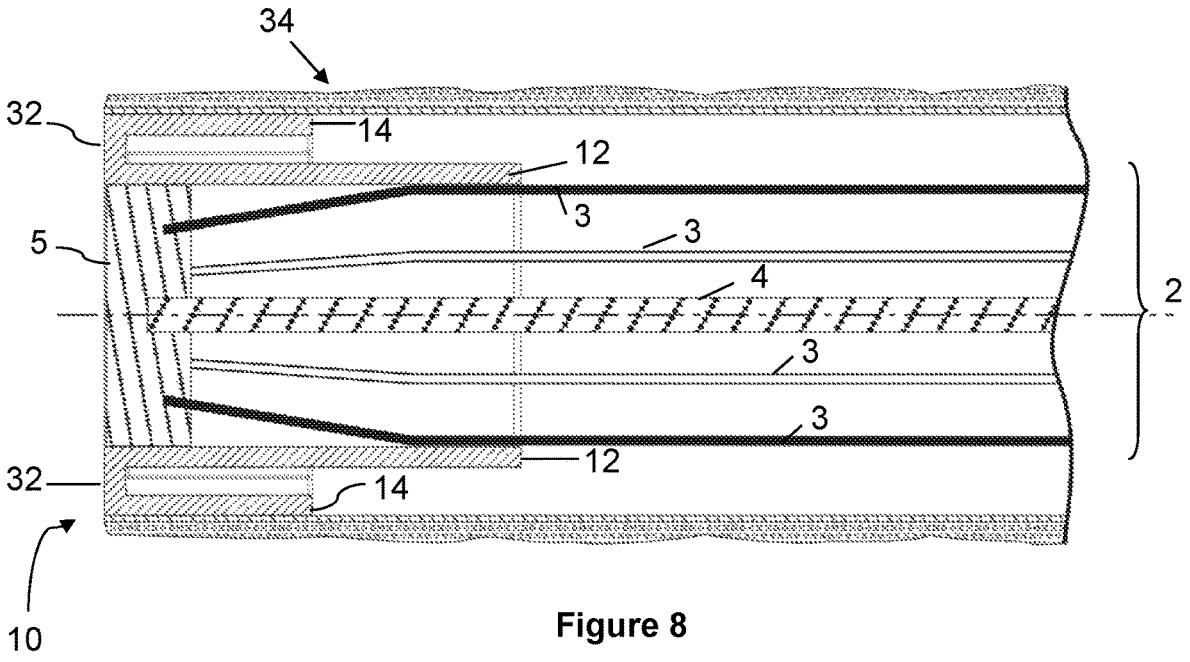
FIG. 8 is a partial cross-sectional side view of the adapter shown in FIG. 2, shown in use, and viewed through the axis of rotation of the paint roller.

The end surface 32 also provides a barrier so little or no paint can travel inside the adapter 10 and into the cage 2. The surface 32 is advantageously located at the end of the of the adapter's length so the final assembly (of cage end support 5 and adapter 10) can be flush with the end of the roller cover 34 as seen in FIG. 8. This prevents any paint build up at the end of the paint roller during use, which can "flick" off the roller onto the newly painted surface, then needing to be smoothed.

In the embodiment shown in the drawings the elongated slots 26 which segment the outer wall 14 extend axially from the end wall 30 to a free end of the outer wall 14. The tab-like S-shaped fingers 28 within the slots 26 are attached to the end wall 30 to give them some added strength and prevent them breaking following repeated on-off installation cycles within a paint roller cover. Alternative arrangements could however be employed, depending on the manufacturing process used to form the adapter. But the inventor has found it efficient to adopt a plastic moulding process such that each adapter can be produced in one piece.

Referring now to FIG. 8 more specifically, there is shown a cross-sectional view of one end of a paint roller using the adapter 10 to connect a large diameter paint roller cover 34 to a paint roller frame 1 having a cage 2 designed for a much smaller paint roller cover. As previously mentioned in relation to FIG. 1, the cage 2 includes a plurality of resiliently deformable metal bars 3 spaced about an axis of rotation of a central shaft 4. The ends of the bars 3 are secured to an end support 5 which serves to hold the bars in fixed circumferential positions and allow the bars to flex inwardly towards the shaft 4.

It can be seen that the length of the inner wall 12 of the adapter 10 must be made sufficient to engage the bars 3 of the cage 2, and thereby ensure that the adapter 10 does not spin or slip on the cage 2. If the cover and cage are securely connected, the roller wouldn't roll and the user would instead wipe the paint onto the wall, resulting in a very different paint finish. In this regard, the inventor has found that a length of about 50-70 mm, and preferably about 60 mm, is suitable.

Similarly, the length of the outer wall 14 must be made sufficient to support the roller cover 34. In this regard, the surface area of the outer surface 22, extending circumferentially between the slots 26 and axially between the end surface 32 and the free end of the outer wall 14, also plays an important role in making a reliable friction fit contact with the internal surface of the core of the roller 34. The broad substantially cylindrical surface area of the outer surface 22 also allows the adapter to travel through the core of the cover 34 without skewing out of alignment. It also increases the surface contact with the core to thereby provide added grip. The inventor has found that a length of about 20-40 mm, and preferably about 30 mm, is suitable.

To install the large roller cover 34 on the conventionally sized cage 2, a user would insert a pair of the adapters 10 into the ends of the roller cover 34. The cover 34 and adapters 10 can then be slid over the cage 2. In doing so, the resilient bars 3 of the cage 2 compress inwardly and grip the inner surface of the inner wall 12.

To make insertion of the adapters into the core of the roller cover 34 easier, each end of the outer wall 14 is provided with chamfered or rounded edges on its outer surface 22. This also enables the adapter to be fitted from either direction.

Because the S-shaped fingers 28 extend beyond the outer surface 22 of the outer wall 14, the axial ends of the fingers 28 preferably have a lead-in feature, on both ends, to ensure the parts slide together more easily. This lead-in feature is preferably provided in the form of a taper, as best seen in FIGS. 2 to 5.

Similarly, to make insertion of the cage 2 into the adapters 10 easier, each end of the inner wall 12 is provided with chamfered or rounded edges on its inner surface 16. This allows the cage 2 to align and pass through the adapters 10 more readily. The cage 2 is then also able to be inserted into the adapter 10 from either end.

Although not specifically depicted in FIG. 8, each tab-like S-shaped finger 28 presses against the internal surface of the core of the large roller cover 34. These fingers thereby grip the internal surface of the cover 34 and prevent it slipping about the adapters 10 as described above.

Overall, the adapters of the present invention conveniently enable a large diameter paint roller cover to be used on a conventional paint roller frame of the type having a cage intended for smaller roller covers. Typically, at least in Australia, conventional roller covers are provided with an internal diameter of 38 mm. However, the adapter could readily be made for any alternative size.

Similarly, the adapter shown in the drawings is designed for a large diameter roller cover having an internal core diameter of 57 mm. However, the same principles could be applied to produce an adapter for any alternative size.

In the latter regard, a range of adapters are envisaged to allow for a range of large diameter roller covers as may be available from a range of manufacturers. The adapters would be sold in pairs such that a single pair of adapters could be purchased and used for roller covers of any length. It is only the respective diameters of a cage and roller cover which would determine the particular adapters to be used. The adapters can thus be produced in a range of convenient sizes and each size would allow for a certain degree of variation in manufacturing tolerances of large diameter roller covers.

Finally, it should be appreciated that the foregoing description and accompanying figures depict just one embodiment of the adapter of the present invention. Other embodiments are possible, by varying the respective internal and external diameters, the axial lengths of the inner and outer walls, and the design of the gripping members which, in the embodiment described above and shown in FIGS. 2 to 8, are formed as shallow S-shaped tabs. The gripping members could, for example, take a different form, as long as they project beyond the external surface of the adapter such that they can press against an internal surface of the paint roller cover.

Figure 9:
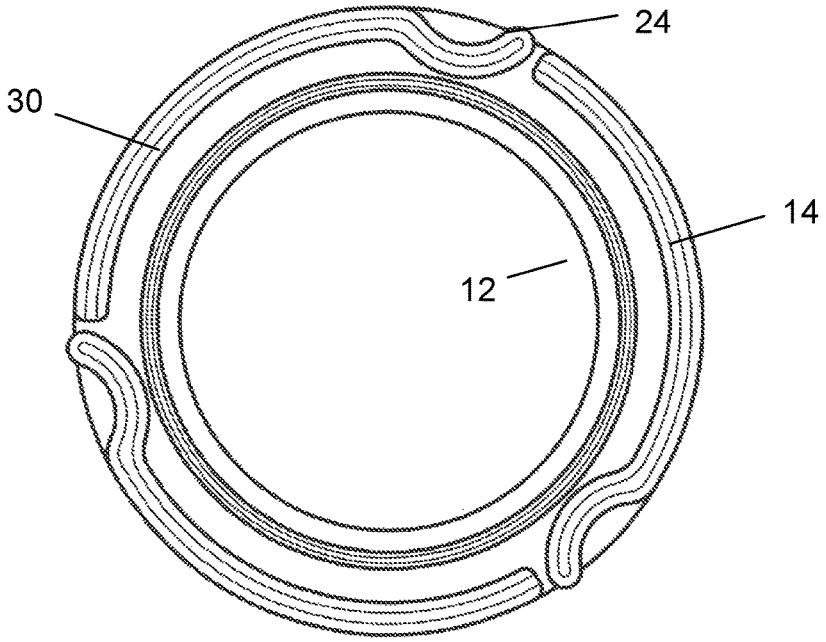
FIG. 9 is an end view of another paint roller adapter in accordance with an alternative embodiment of the invention, this view being equivalent to the end view of the adapter shown in FIG. 7.

For example, each gripping member may be formed within a portion of the outer wall 14, as provided in the alternative embodiment of the invention depicted in FIG. 9 of the drawings. In this embodiment, a portion of the outer wall 14 is formed like a leaf spring such that a free end of the spring projects outward, beyond the external surface of the adapter, to press against the internal surface of the paint roller cover.

Figure 10:
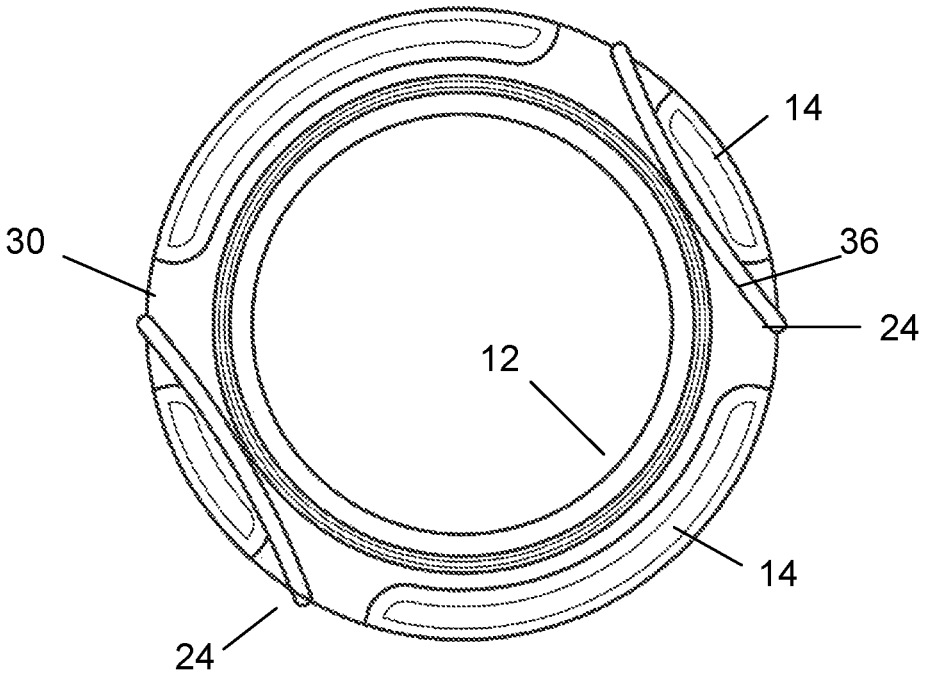
FIG. 10 is an end view of another paint roller adapter in accordance with a further alternative embodiment of the invention, this view again being equivalent to the end view of the adapter shown in FIG. 7.

In a further alternative shown in FIG. 10, a pair of gripping members 24 is provided at the free ends of a separate wall element 36 which is joined to the end wall 30 but not to the outer wall 14. Once again, the free ends of the wall element 36 forming the gripping members 24 project outward, beyond the external surface of the adapter, to press against the internal surface of the paint roller cover.

Other arrangements are also possible. For example, the gripping members may be formed as small projections, such as raised bumps, on the outer surface 22 of the outer wall 14.

Some resilience in the gripping members is desirable and this could be provided in a number of ways. For example, a resilient material could be used to form compressible fingers or raised bumps, or the gripping members could take the form of flexible teeth which engage the inner surface of the roller cover.

Other variations of the inventive concepts described above would become apparent to a person skilled in the art and these variations are clearly encompassed by the present invention and fall within the scope of the appended claims.

The invention claimed is:

1. A paint roller adapter for enabling a relatively large paint roller cover to be used on a paint roller frame which has a cage configured to receive smaller paint roller covers, the adapter being generally cylindrical in shape, as herein defined, and comprising:

a cylindrical internal surface having a diameter sized to fit onto the cage of the roller frame;

a substantially cylindrical external surface having a diameter sized to fit within the large paint roller cover;

at least one gripping member which projects outward beyond the external surface such that, in use, the gripping member(s) press against an internal surface of the large paint roller cover; and a pair of coaxial cylindrical walls, one at least partially within the other, such that they are spaced about an axis of rotation of the cage when in use, and wherein:

an inner wall has radially inner and outer surfaces such that the inner surface of the inner wall defines said internal surface of the adapter;

an outer wall has radially inner and outer surfaces such that the outer surface of the outer wall defines said external surface of the adapter;

the outer wall includes a plurality of apertures spaced around the circumference of the outer wall; and each gripping member comprises a substantially radially extending finger which projects from the outer surface of the inner wall through a said aperture in the outer wall.

2. The paint roller adapter of claim 1 wherein the at least one gripping member comprises a plurality of gripping members.

3. The paint roller adapter of claim 2 wherein three gripping members are provided.

4. The paint roller adapter of claim 1 wherein each radially extending finger has an S-shape when viewed in cross section in a plane perpendicular to the axis.

5. The paint roller adapter of claim 1 wherein each aperture in the outer wall comprises an elongated slot which extends axially along the outer wall, and each radially extending finger has a wide tab-shape with:

its width extending axially along the corresponding slot;

its thickness extending across the slot; and its length extending substantially radially from the outer surface of the inner wall towards and through the slot in the outer wall.

6. The paint roller adapter of claim 1 wherein each radially extending finger is resiliently deformable by compression towards the axis.

7. The paint roller adapter of claim 6 wherein each radially extending finger comprises a shallow S-shape when viewed in cross section in a plane perpendicular to the axis.

8. The paint roller adapter of claim 1, further comprising an end wall having an outer surface extending radially between the cylindrical internal surface and the substantially cylindrical external surface.

9. The paint roller adapter of claim 8 wherein the slots in the outer wall extend axially from the end wall to a free end of the outer wall.

10. The paint roller adapter of claim 1, wherein the inner wall has a length of about 50 to 70 mm and the outer wall has a length of about 20 to 40 mm.

11. The paint roller adapter of claim 10 wherein the inner wall has a length of about 60 mm and the outer wall has a length of about 30 mm.

12. The paint roller adapter of claim 1 wherein the cylindrical internal surface has a diameter of about 38 mm and the substantially cylindrical external surface has a diameter of about 57 mm.

13. The paint roller adapter of claim 11 wherein the cylindrical internal surface has a diameter of about 38 mm and the substantially cylindrical external surface has a diameter of about 57 mm.

* * * * *